US007380499B2

(12) United States Patent
Muraoka et al.

(10) Patent No.: US 7,380,499 B2
(45) Date of Patent: Jun. 3, 2008

(54) IMAGE RECORDING APPARATUS AND PRINTING PLATE MATERIAL

(75) Inventors: Masayuki Muraoka, Hachioji (JP); Shinichi Matsubara, Hachioji (JP); Yoshio Miyaushiro, Hachioji (JP); Hirohisa Tanaka, Kyoto (JP); Toshio Tamura, Kyoto (JP)

(73) Assignees: Konica Minolta Medical & Graphic, Inc. (JP); Dainippon Screen Mfg. Co., Ltd. (JP)

( * ) Notice: Subject to any disclaimer, the term of this patent is extended or adjusted under 35 U.S.C. 154(b) by 266 days.

(21) Appl. No.: 11/014,515

(22) Filed: Dec. 16, 2004

(65) Prior Publication Data

US 2005/0139106 A1 Jun. 30, 2005

(30) Foreign Application Priority Data

Dec. 25, 2003 (JP) ..... 2003-428591

(51) Int. Cl.
*B41C 1/10* (2006.01)
*B41N 1/14* (2006.01)

(52) U.S. Cl. ..... 101/401.1; 101/453; 101/467

(58) Field of Classification Search ..... 101/453, 101/467, 401.1
See application file for complete search history.

(56) References Cited

U.S. PATENT DOCUMENTS 5,064,745 A * 11/1991 Kondo et al. ..... 430/265
5,339,737 A * 8/1994 Lewis et al. ..... 101/454
5,965,326 A * 10/1999 Ellis ..... 430/309
6,105,501 A 8/2000 Phillips et al.
6,186,067 B1 * 2/2001 Rorke et al. ..... 101/467
6,284,433 B1 * 9/2001 Ichikawa et al. ..... 430/303
6,458,507 B1 * 10/2002 Burberry et al. ..... 430/270.1
2002/0009574 A1 1/2002 Hiraoka
2002/0172891 A1 11/2002 Mori

FOREIGN PATENT DOCUMENTS

EP 810099 A2 * 12/1997
EP 1 256 845 A2 11/2002
EP 1 266 751 A2 12/2002
EP 1 371 484 A2 12/2003
WO WO 92/14609 9/1992

* cited by examiner

*Primary Examiner*—Leslie J Evanisko
(74) *Attorney, Agent, or Firm*—Lucas & Mercanti, LLP

(57) ABSTRACT

A sheet printing plate material includes a plastic support having optical transparency for infrared light, and at least a hydrophilic layer and a thermosensitive image formed layer formed on the plastic support, wherein the sheet printing plate material is wound on a drum having surface reflectance of 0.1 to 10% at a wavelength to be used, and the sheet printing plate material is used for a image recording apparatus where the drum is rotated to expose an image data with a light source so that an image is recorded.

7 Claims, 8 Drawing Sheets

FIG.9

| | | |
|---|---|---|
| SHEET PRINTING PLATE MATERIAL A | TRANSMITTANCE | 5% |
| SHEET PRINTING PLATE MATERIAL B | TRANSMITTANCE | 25% |
| DRUM a | REFLECTANCE | 2% |
| DRUM b | REFLECTANCE | 7% |
| DRUM c | REFLECTANCE | 15% |
| DRUM d | REFLECTANCE | 28% |

FIG.10

| DRUM / SHEET PRINTING PLATE MATERIAL | a | b | c | d |
|---|---|---|---|---|
| A | A | A | A | C |
| B | A | B | C | C |

IMAGE RECORDING APPARATUS AND PRINTING PLATE MATERIAL

BACKGROUND OF THE INVENTION

1. Field of the Invention

The present invention relates to an image recording apparatus for performing a scanning exposure of an image to the sheet printing plate material and the printing plate of plastic support.

2. Description of the Related Art

In earlier development, an image recording apparatus is disclosed, where a sheet printing plate material of a plastic support or a printing plate is wound on a surface of a drum, and the drum is rotated to perform scanning exposure of an image data with a light source so that an image is recorded.

In a recording apparatus for an aluminum printing material, a reflectance on a surface of a drum is not mentioned because aluminum itself does not transmit light. Further, in a recording apparatus for film or paper, reflection density only in visible light range has been mentioned.

There are following problems in performing scanning exposure of an image data with a light source using the sheet printing plate material or printing plate having a plastic support so that an image is recorded.

Firstly, in the case of the sheet printing plate material of plastic support, it has transparency of infrared light used for an exposure, compared to the aluminum printing material, or film or paper. Thus, light which has not been converted to heat at a thermosensitive image forming layer is transmitted through the plastic support, and is reflected on a surface of a drum so as to react at the thermosensitive image forming layer again, so that the image density increases more than necessary.

Secondly, when some concavoconvex such as clamp groove, suction groove and peel groove is formed on a surface of the drum of the image recording apparatus, density nonuniformity occurs since the distance between the bottom of the groove and the plastic support is different from the distance between the surface of the drum and the plastic support and a reaction on the thermosensitive image forming layer varies.

Thirdly, when backside of the plastic support is colored so as not to transmit infrared light, the backside is heated due to the coloring and density nonuniformity occurs in the thermosensitive image forming layer since the heat transmittances are different between metal of the surface of the drum and the air layer of the groove.

SUMMARY OF THE INVENTION

The present invention is accomplished in view of the above problems, and the object of the invention is to provide a sheet printing plate material and an image recording apparatus where the above first to third problems are solved and occurrence of density nonuniformity is suppressed.

In order to accomplish the above object, a sheet printing plate material comprising a plastic support having optical transparency for infrared light, and at least a hydrophilic layer and a thermosensitive image formed layer formed on the plastic support, wherein the sheet printing plate material is wound on a drum having surface reflectance of 0.1 to 10% at a wavelength to be used, and the sheet printing plate material is used for a image recording apparatus where the drum is rotated to expose an image data with a light source so that an image is recorded.

By forming at least a hydrophilic layer and a thermosensitive layer on a plastic support having optical transparency for infrared light and making surface reflectance of the drum at a wavelenght of light to be used be 0.1 to 10%, the reflectance on the surface of the drum is reduced. Thus, the first problem that light which has not been converted to heat at a thermosensitive image forming layer is transmitted through the plastic support and is reflected on the surface of the drum to react at the thermosensitive image forming layer again, so that the image density increases more than necessary, is solved so that density nonuniformity can be reduced.

It is preferable that the wavelength to be used is 750 to 1000 nm and the sheet printing plate material has transmittance of 1 to 30% at the wavelength to be used.

By making the wavelength to be used be 750 to 1000 nm and the sheet printing plate material have transmittance of 1 to 30% at the wavelength to be used, effectiveness of light heat conversion increases. Since the transmitted light decreases, the first problem that the image density increases more than necessary is solved more reliably, so that density nonuniformity can be reduced.

The plastic support is preferably made of polyethylene terephthalate.

By making the plastic support being made of polyethylene terephthalate, the above first problem is solved more reliably, so that density nonuniformity can be reduced and properties of handling and transportation are improved.

The plastic support may have 100 to 250 μm thick.

By making the plastic support have 100 to 250 μm thick, the sheet printing plate material can be rolled easily and property of transportation in the image forming apparatus is improved. Further, since the sheet printing plate material has sufficient strength due to the above thickness thereof, a problem of bending or the like in carrying it to a printer used in next step can be solved.

An image recording apparatus is one wherein a sheet printing plate material comprising a plastic support and a hydrophilic layer and a thermosensitive layer provided on the plastic support is wound on a surface of a drum, the drum is rotated to perform an scanning exposure of an image with a light source so that an image is recorded, and the drum has surface reflectance of 0.1 to 10% at a wavelength to be used.

By forming at least a hydrophilic layer and a thermosensitive layer on a plastic support having optical transparency for infrared light and making surface reflectance of the drum at a wavelength of light to be used be 0.1 to 10%, the reflectance on the surface of the drum is reduced. Thus, the first problem that light which has not been converted to heat at a thermosensitive image forming layer is transmitted through the plastic support and is reflected on the surface of the drum to react at the thermosensitive image forming layer again, so that the image density increases more than necessary, is solved so that density nonuniformity can be reduced.

The wavelength to be used is preferably 750 to 1000 nm.

By making the wavelength to be used be 750 to 1000 nm, scanning exposure of an image data can be performed to the sheet printing plate material of a plastic support and the above first problem that the image density increases more than necessary is solved. Thus, density nonuniformity can be reduced.

The light source is preferably a semiconductor laser.

By making the light source be a semiconductor laser, scanning exposure of an image can be performed to the sheet printing plate material of a plastic support and the above first problem that the image density increases more than necessary is solved. Thus, density nonuniformity can be reduced.

The surface of the drum is preferably formed by a surface treatment containing a carbon black pigment.

Since the surface of the drum is formed by a surface treatment containing a carbon black pigment so that the reflectance at the surface of the drum is reduced, the problem that light which has not been converted to heat at a thermosensitive image forming layer of the sheet printing plate material is transmitted through the plastic support and is reflected on a surface of a drum to react at the thermosensitive image forming layer again, so that the image density increases more than necessary is solved so that density nonuniformity can be reduced.

The image forming apparatus may further comprise an exposing unit, and the exposing unit may have image intensity of 100 to 400 mJ/cm$^2$ in image recording. Here, image intensity represents energy amount per unit area on a printing plate material in exposure.

By lowering the image intensity such like 100 to 400 mJ/cm$^2$, the transmitted and return light thereof decreases and density nonuniformity can be reduced under certain condition of the sheet printing plate material and drum. Thus, the first problem is solved and the density nonuniformity can be reduced.

BRIEF DESCRIPTION OF THE DRAWINGS

The present invention will become fully understood by the following detailed description and the accompanied drawings. However, they are only intended to explain the invention and do not limit the scope of the invention, and wherein, FIG. 9 is a view showing transmittance of the sheet printing plate material and the reflectance of the drum, and FIG. 10 is a view showing density nonuniformity.

DETAILED DESCRIPTION OF THE PREFERRED EMBODIMENT

Hereinafter, the embodiment of the sheet printing plate material and printing plate, and the image recording material according to the present invention are explained. However, the present invention is not limited the present embodiment. The embodiment of the invention shows the best mode for carrying out the invention, and the definition of the wording of the invention is not limited thereto. Since the printing plate material and sheet printing plate are constituted similarly to each other, the sheet printing plate material is explained below.

Figure 1:
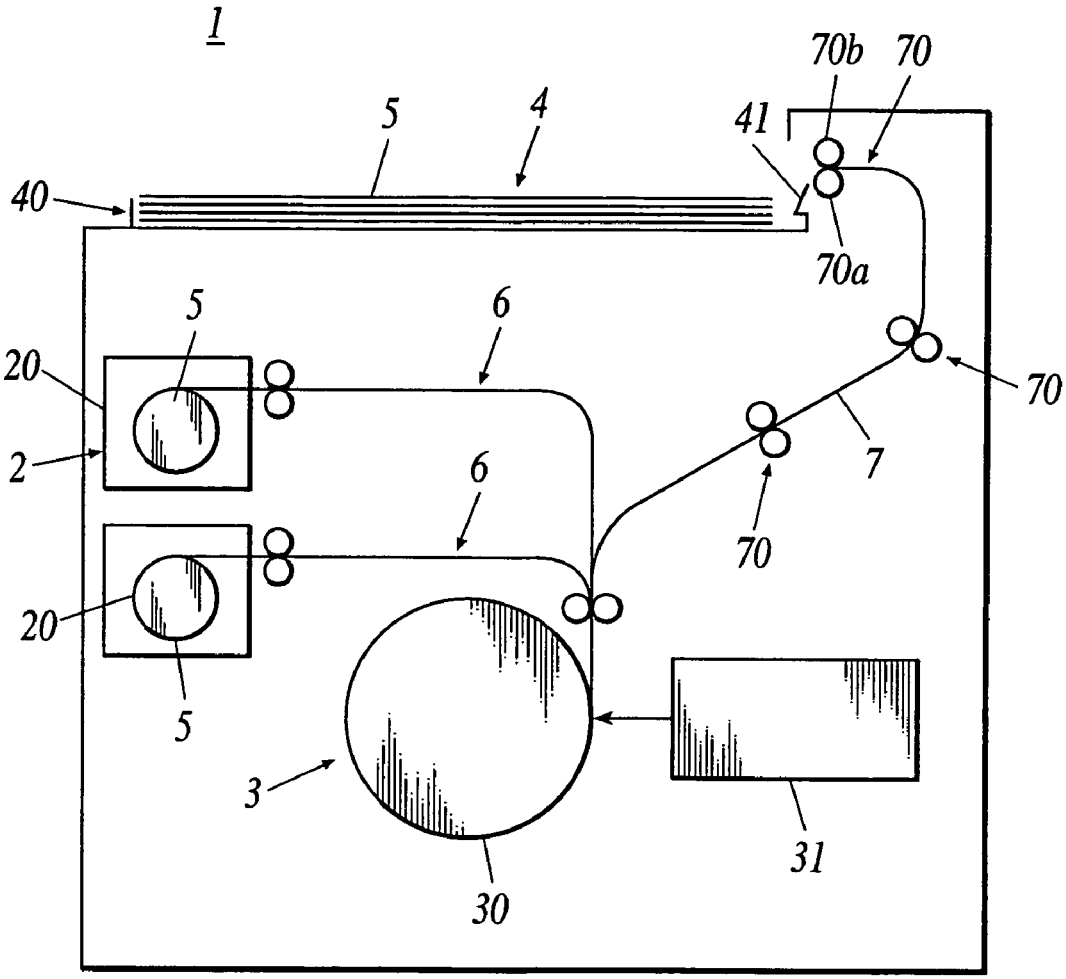
FIG. 1 is a schematic constitutional view of the image recording material.

FIG. 1 is a schematic constitutional view of the image recording material.

An image recording apparatus 1 of the present embodiment comprises a feeding unit 2, a recording unit 3 and an ejecting unit 4.

A plurality of magazines 20 are disposed to the feeding unit 2. A sheet printing plate material 5 is fed through feeding path 6 to the recording unit 3 from the magazine 20.

A drum 30 and an exposing unit 31 are disposed to the recording unit 3, so as to wind the sheet printing plate material 5 along the surface of the drum 30.

As for the winding to the surface of the drum 30, the sheet printing plate material 5 is wound onto a part of or whole of the surface of the drum 30 with closely contacted by suction according to the size of the sheet printing plate material 5.

The drum 30 is rotated in a state that the sheet printing plate material 5 is wound on the surface of the drum 30, scanning exposure of an image data to the sheet printing plate material 5 is performed with a light source of the exposing unit 31, while the beam intensity thereof increases and decreases, so that an image is recorded. The printing plate material 5 where image has been recorded is ejected through an ejecting path 7 to a tray 40 of the ejecting unit 4.

Figure 2:
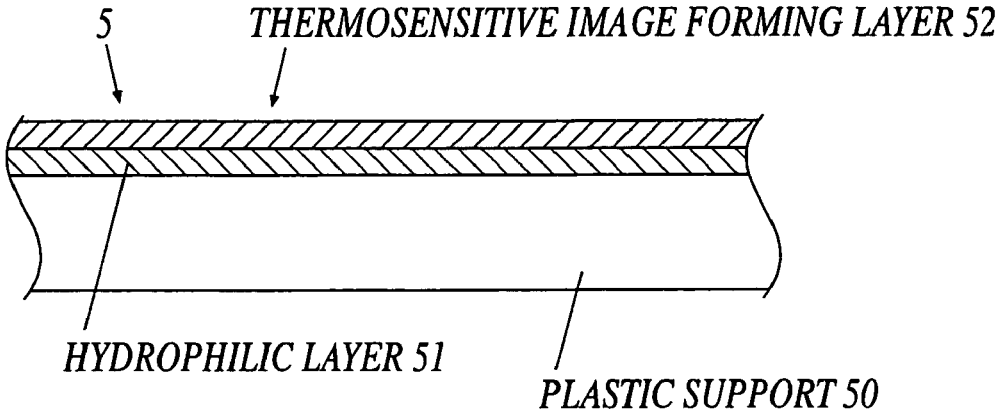
FIG. 2 is a view showing layer composition of the sheet printing plate material.

The sheet printing plate material 5 is constituted as shown in FIG. 2.

FIG. 2 is a view showing layer composition of the sheet printing plate material.

The sheet printing plate material 5 of the present embodiment comprises at least a hydrophilic layer 51 and a thermosensitive image forming layer 52 on the plastic support 50 having transparency for infrared light. As for the plastic support 50, for example, it is preferable to use a polyethylene terephthalate base. As for the thickness of the plastic support 50, when it is too thick or too thin, it is difficult to wind and has problem in transportation in the image recording apparatus, and when it is too thin, there is a problem of bending or the like in carrying it to an printer used in next step caused by poor strength. Thus, the thickness of the plastic support is preferably 100 to 250 μm and more preferably 170 to 180 μm from the viewpoint of transportation, handling and the like.

The sheet printing plate material 5 has transmittance of 1 to 30% at a light source wavelength to be used. The lower transmittance of the printing plate material at infrared light leads the higher light heat conversion, and the transmitted light is reduced. Thus, the problem that light which has not been converted to heat at the thermosensitive image forming layer 52 of the sheet printing plate material 5 is transmitted through the plastic support 50 and is reflected on the surface of the drum 30 to react at the thermosensitive image forming layer 52 again, so that the image density increases more than necessary is solved, and density nonuniformity can be reduced.

Figure 3:
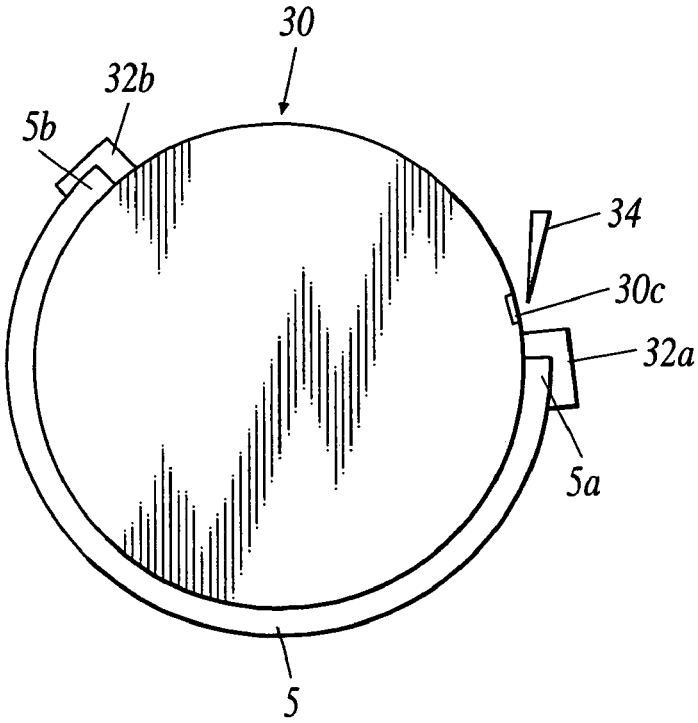
FIG. 3 is a view showing a state where the printing plate material is wound around the drum.
Figure 4:
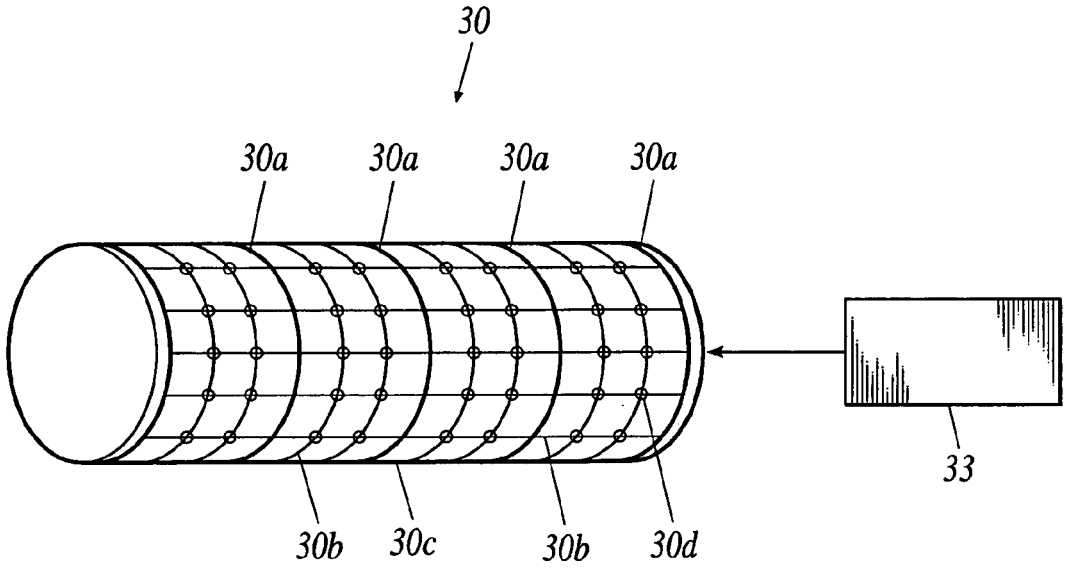
FIG. 4 is a perspective view of the drum.
Figure 5A:
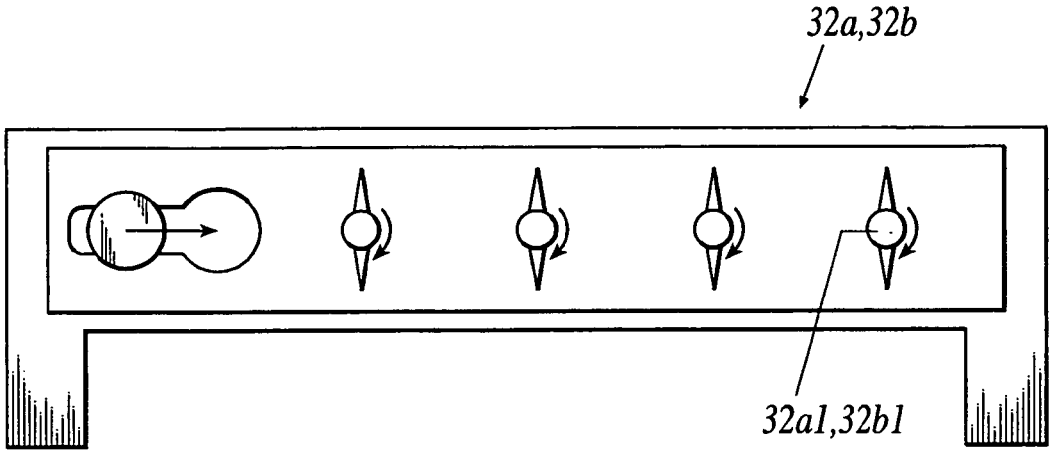
FIG. 5 is a view showing a clump unit.
Figure 5B:
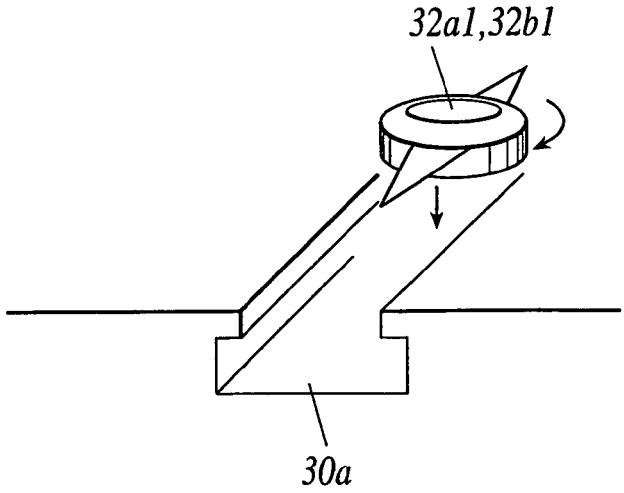

The drum 30 of the present embodiment is constituted as shown in FIGS. 3 to 5.

FIG. 3 is a view showing a state where the printing plate material is wound on the surface of the drum, FIG. 4 is a perspective view of the drum, and FIG. 5 is a view showing a clump unit.

The drum 30 of the present embodiment comprises a clump groove 30*a* and a suction groove 30*b*. The clump groove 30*a* also works as a peel groove. However, a peel groove can be provided separately.

The clump groove 30*a* is formed on a circumference of the drum 30 with a predetermined interval corresponding to a size of the sheet printing plate material.

A front end 5*a* of the sheet printing plate material 5 is fixed with a front end fixing clump 32*a*, and a back end 5*b* is fixed with a back end fixing clump 32*b*.

The front end clump 32*a* and the back end clump 32*b* engage lock hooks 32*a*1 and 32*b*1 to the clump groove 30*a* so as to hold it, as shown in FIG. 5.

The suction groove 30*b* is formed on a whole area of the drum 30, and the suction groove 30*b* communicates to a suction hole 30*d*.

A vacuum unit 33 decompress inside of the drum 30, so that the sheet printing plate material 5 is adhered to the drum 30 in a wound state with the suction hole 30*d* and the suction groove 30*b*.

The shape and aperture area of the suction hole 30*d* provided to the drum 30 of the present embodiment are not limited especially. Generally, it is round shape or groove shape. The shape, area and density of the opening can be changed according to a position of the clump unit.

The clump groove 30*a*, suction groove 30*b* and peel groove 30*c* formed as the clump groove or formed separately are not limited in their position, size and the like, and it can be suitably applied when at least one of these groove is provided.

The sheet printing plate material 5 on which an image has been recorded is peeled from the front end 5*a* of the sheet printing plate material 5 by disposing the peeling hook 34 at the peel groove 30*c* formed also as the clump groove 30*a* after letting the front end clump 32*a* being away.

The surface of the drum 30 is formed by a surface treatment containing a carbon black pigment.

It is preferable that the reflectance on the surface of the drum 30 is 0.1 to 10% at a light source wavelength to be used, and more preferably the reflectance is 1 to 8%. Since the reflectance at the surface of the drum is reduced, the problem that light which has not been converted to heat at a thermosensitive image forming layer 52 of the sheet printing plate material 5 is transmitted through the plastic support 50 and is reflected on a surface of a drum 30 to react at the thermosensitive image forming layer 52 again, so that the image density increases more than necessary is solved so that density nonuniformity can be reduced.

The light source wavelength to be used is 750 to 1000 nm. Scanning exposure of an image data is performed to the sheet printing plate material 5 of the plastic support 50, so that nonuniformity of density can be reduced.

A semiconductor laser is preferably applied to the exposing unit 31 of the present embodiment as a light source. The image intensity is 100 to 400 mJ/cm$^2$ in image recording. By lowering the image intensity, the transmitted light and the return light thereof decreases when the sheet printing plate material 5 and drum 30 are under certain condition. Thus density nonuniformity can be reduced.

Figure 6:
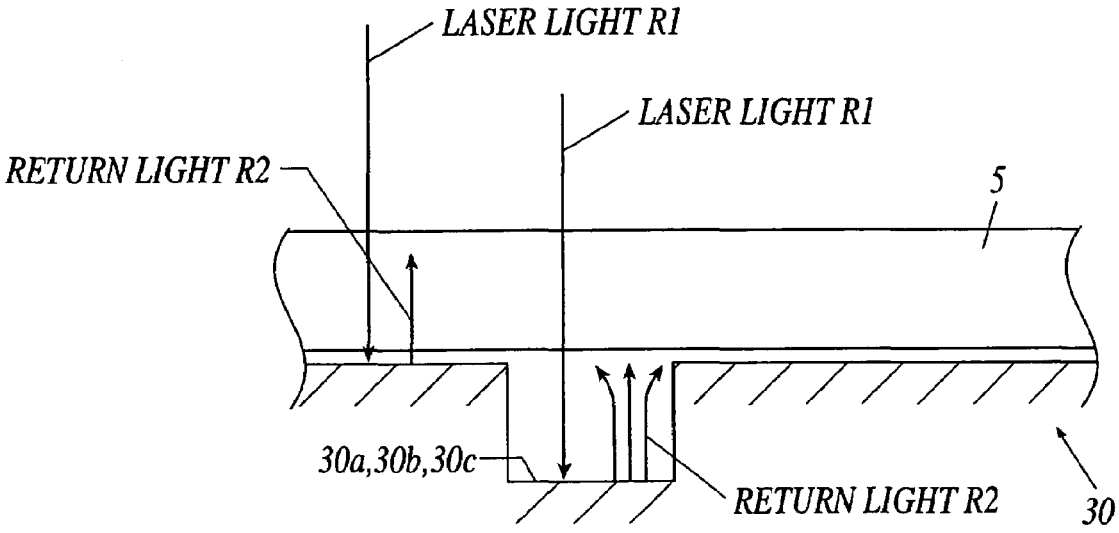
FIG. 6 is a view showing a state where scanning exposure of an image is performed with the light source in the exposing part so that the image are recorded.
Figure 7:
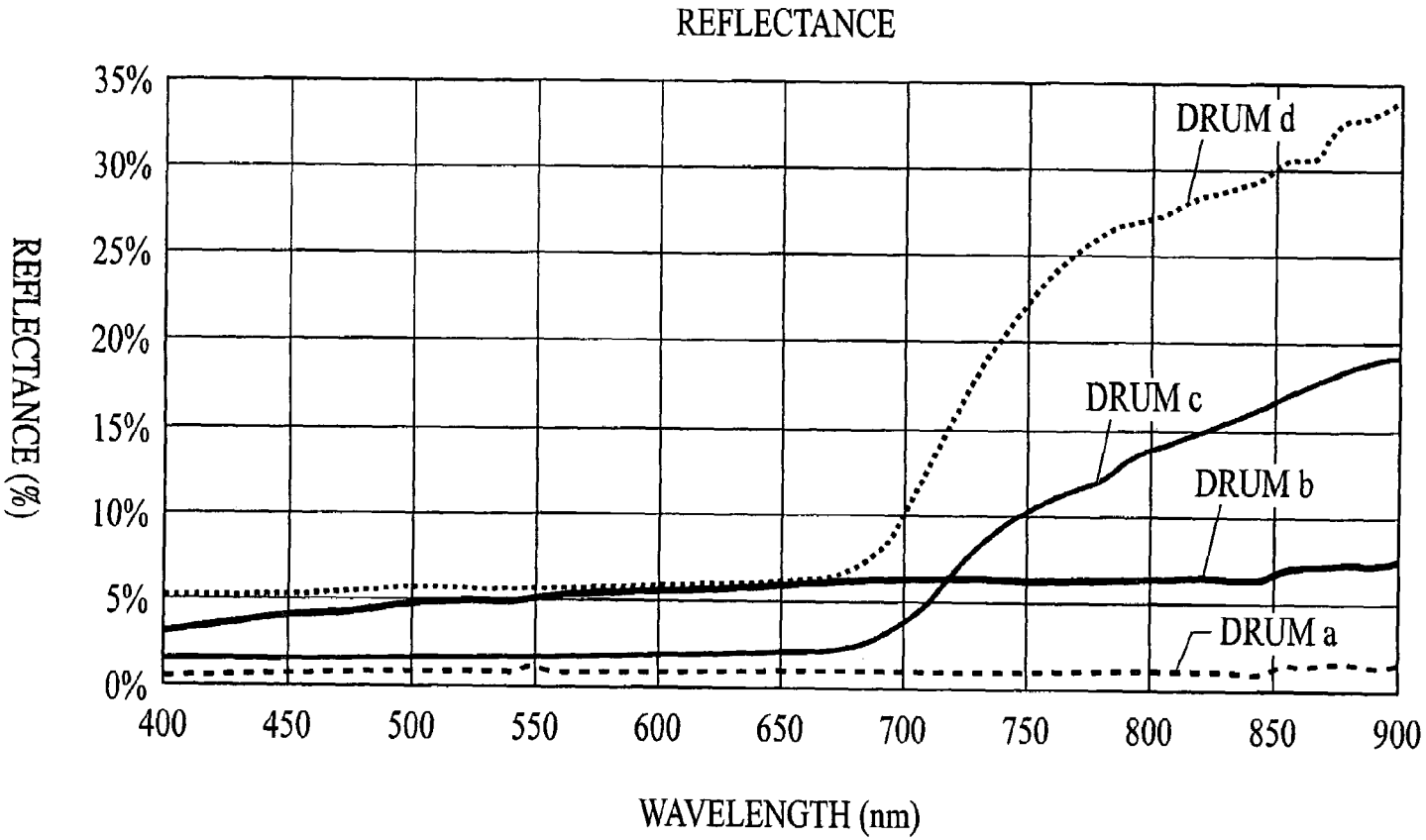
FIG. 7 is a view showing a relation between reflectance and wavelength in exposing light to the sheet printing plate material.

As is shown in FIG. 6, the image recording apparatus 1 of the present embodiment performs scanning exposure of an image with the light source of the exposing part 31 by rotating the drum 30, so that the image is recorded. In the scanning exposure, when the reflectance of the drum 30 is high, a laser light R1 of the semiconductor laser is reflected to be a return light R2 so that the thermosensitive image forming layer reacts and is intensified.

Since there is clearance at the clump groove 30*a*, suction groove 30*b* and the peel groove 30*c* formed also as the clump groove 30*a* or formed separately, the return light R2 is diffused and the energy thereof is attenuated to cause density nonuniformity.

In the present embodiment, the reflectance on the surface of the drum 30 is 0.1 to 10% at the light source wavelength to be used. By lowering the reflectance on the surface of the drum 30, the difference of infrared return light between on the surface of the drum 30 and on the bottom of the groove is reduced, so that density nonuniformity is reduced.

The reflectance can be 1 to 8%. By further lowering the reflectance on the surface of the drum 30 more, the difference of infrared return light between on surface of the drum 30 and on the bottom surface of the groove is reduced, so that density nonuniformity is reduced.

The light source wavelength to be used is 750 to 1000 nm. Scanning exposure of an image can be performed to the sheet printing plate 5 of the plastic support.

The light source is a semiconductor laser. Thus, scanning exposure of an image can be performed to the sheet printing material 5 of the plastic support.

The surface of the drum 30 is formed by a surface treatment containing a carbon black pigment. One of the methods for coloring the drum surface is to use dye. General black dye has low effect to reduce reflection of infrared light, and it is impossible to reduce density nonuniformity. However, when a carbon black pigment is contained, the pigment absorbs infrared light. Thus it has high effect to reduce the reflection.

The sheet printing plate material 5 has transmittance of 1 to 30% at a light source wavelength to be used, and the transmittance is preferably 1 to 5%. The lower transmittance of the image forming layer of the printing plate at infrared light leads the higher light heat conversion, so that the transmitted light is reduced. Thus, density nonuniformity can be reduced even if the reflectance of infrared light on the drum surface is rather high.

The image intensity is 100 to 400 mJ/cm$^2$ at image recording. By lowering the image intensity, the transmitted and return light decreases when the sheet printing plate material 5 and drum 30 are under certain conditions, so that density nonuniformity can be reduced.

Hereinafter, the sheet printing plate material and the like of the present embodiment will be explained in detail.

<Plastic Support>

As for the plastic support used in the present embodiment, polyester such as polyethylene terephthalate and polyethylene naphthalate, polyimide, polyamide, polycarbonate, polysulfone, polyphenylene oxide, and cellulose esters can be given.

In particular, polyester films such as polyethylene terephthalate and polyethylene naphthalate are preferable.

It is particularly preferable that the plastic support is polyethylene terephthalate from the viewpoint of transportation and handling. As for the thickness of the plastic support, when it is too thick or too thin, it is difficult to wind and has problem in transportation in the image recording apparatus, and when it is too thin, there is a problem of bending or the like in carrying it to an printer used in next step caused by poor strength. Thus, the thickness of the plastic support is preferably 100 to 250 μm and more preferably 170 to 180 μm from the viewpoint of transportation and handling.

Corona discharge treatment, flame treatment, plasma treatment, ultraviolet irradiation treatment and the like can be given to the surface of the plastic support in order to ensure adherence with the hydrophilic layer.

The surface of the support can be roughened mechanically with sand blast, brash polishing or the like.

An undercoat layer of latex having hydrophilic functional group or hydrophilic resin can be provided to the surface of the plastic support.

It is preferable that the sheet printing plate material 5 has transmittance of 1 to 30% at the light source wavelength to be used, and it is more preferable that the transmittance is 1 to 5%.

The plastic support is applied to the image recording apparatus having reflectance on the surface of the drum of 0.1 to 10% at the light source wavelength to be used. Thus, reading the reflection on the surface of the drum 30 solves the problem that light which has not been converted to heat at the thermosensitive image forming layer 52 of the sheet printing plate material 5 is transmitted through the plastic support 50 and is reflected on the surface of the drum 30 to react at the thermosensitive image forming layer 52 again, so that the image density increases more than necessary is solved. Since density nonuniformity can be reduced, it is a preferable embodiment.

It is preferable that the light source used in the present embodiment is a semiconductor laser and the image intensity is 100 to 400 mJ/cm$^2$ in an image recording. As for the laser light source, argon laser, He—Ne gas laser, YAG laser, semiconductor laser and the like can be given.

Since a semiconductor laser having comparatively long wavelength in infrared range is effectively used, compounds which absorb, diffuse and reflect light at a wavelength in these range can be contained in order to attain the above transmittance, As for the compounds to reflect and diffuse light at exposing wavelength, titanium oxide, barium sulfate, zinc oxide, calcium carbonate, polyethylene and the like can be given. It is preferable that they are diffused and mixed into the material plastic in forming a film of the plastic support.

As for the compound absorbing light at exposing wavelength, it can be selected from carbon black, metal salt of phthalocyanine such as copper, aluminum and titanium, cyanine system coloring matter, polymethine system coloring matter, squalium system coloring matter and the like. It is preferable that it is diffused and mixed into the material plastic in forming a base material.

<Functional Layer>

A functional layer of the sheet printing plate material of the present embodiment comprises the hydrophilic layer and the thermosensitive image forming layer provided thereon.

(Hydrophilic Layer)

The Hydrophilic layer designates a layer to which printing ink does not adhere in printing. As for the material to form the hydrophilic layer, the following can be given.

As for the material to form the hydrophilic layer, organic hydrophilic matrix structure obtained by cross-linking or pseudo cross-linking of organic hydrophilic polymers, inorganic hydrophilic matrix structure obtained by the sol-gel transformation which consists of a hydrolysis and condensation reaction of polyalkoxysilane, titanate, zirconate or aluminumate, and metal oxide, and the like can be used preferably.

It is particularly preferable that the hydrophilic layer contains metal oxide fine particles. For example, colloidal silica, alumina sol, titania sol, and the other metal oxide sols can be given.

As for the shape of the metal oxide fine particles, any shapes such as globular, needle, feather, and the like can be given. The mean particle size is preferably 3 to 100 nm, and several kinds of metal oxide having different mean particle sizes each other can be used in combination. Further, a surface treatment can be given to the surface of the particles.

The above metal oxide fine particles can be used as a binder by utilizing the coating property thereof.

It is suitably applied to the hydrophilic layer since it has a lower effect to decreasing hydrophilicity than an organic binder.

Among them, colloidal silica is preferably applied to the hydrophilic layer.

Colloidal silica has an advantage of having high coating property even in a comparatively low temperature and dry condition. Thus, preferable strength can be obtained. As for the colloidal silica available to the present embodiment, it preferably contains colloidal silica of necklace-structure and fine particle colloidal silica having a mean particle size of 20 nm or less. Further, colloidal solution of the colloidal silica is preferably alkaline.

As for the porous substance having matrix structure, which is one of the materials constituting the hydrophilic layer, porous metal oxide particles having particle size of 1 μm or less can be used.

As for the porous metal oxide particles, porous silica particles or porous aluminosilicate particle which are described below, or zeolite particles can be used.

Generally, porous silica particles are manufactured by wet method or dry method.

In wet method, gel obtained by neutralization of silicate solution is dried and grinded, or precipitate deposited by neutralization is grinded, so that porous silica particles are obtained.

In dry method, tetrachlorosilicate is burned with hydrogen and oxygen to deposit silica, so that porous silica is obtained.

These particles can be controlled in its porous property and particle size by regulating the manufacturing condition thereof.

The porous silica obtained by gel in wet method is particularly preferable.

The porous property of the particles is preferably 0.5 ml/g or more by pore volume, 0.8 ml/g or more is more preferable and 1.0 to 2.5 ml/g is further more preferable. The pore volume is closely related to water retention of an applied film. The larger pore volume gives the better wet retention, the more resistance to be contaminated in printing, and the larger latitude of water content.

The hydrophilic layer of the sheet printing plate material can contain layered clay mineral particles. As for the layered clay mineral particles, for example, clay minerals such as kaolinite, halloysite, talc, smectites (montmorillonite, beidellite, hectorite, saponite, etc.), vermiculite, mica, and chlorite, and hydrotalcite, layered poly-silicicate (kanemite, makatite, Ilerite, magadiite, kenyaite, etc.), and the like can be given. In particular, it is believed that the higher charge density in a unit layer gives the higher polarity and the higher hydrophilicity (the charge density is preferably 0.25 or more, more preferably 0.6 or more).

As for the layered mineral having the above charge density, smectite (charge density of 0.25 to 0.6, negative charge), vermiculite (charge density of 0.6 to 0.9, negative density) and the like can be given.

In particular, synthetic fluoromica is preferable since one having stable quality such as particle size is available.

Among the synthetic fluoromica, one having swelling property is preferable, and one showing free swelling is more preferable.

Intercalation compound of the above layered crystal (such as pillared crystal) and the above layered crystal to which ion-exchange treatment or surface treatment (such as silane coupling treatment and conjugation treatment with an organic binder) is given can be used.

The size of a tabular layered mineral particle is preferably less than 1 μm by mean particle size (maximum length of a particle) under a condition that the particles are contained in the layer (including the cases where swelling process and diffusing and peeling process has been given), and the average aspect ratio is preferably 50 or more.

When the particle size is within the above range, the applied film acquires continuity in plane direction and flexibility which are characteristics of layered particles. Thus, the applied film can be resistant to be cracked and can be rigid in a dry state.

When the solution to be applied contains a lot of particulate matters, precipitation of the particle matters can be inhibited due to bodying up effect of the layered clay mineral.

When the particle size is more than the above range, the applied film may show nonuniformity and the intensity may weaken locally.

When the aspect ratio is less than the above range, the number of tabular particles per loading amount decreases and the bodying up effect become insufficient. Thus, the effect to inhibit precipitation of the particulate matters decreases.

The content of the layered mineral particles is preferably 0.1 to 30 mass % with respect to the whole layer, and 1 to 10 mass % is more preferable.

In particular, expansive synthetic fluoromica and smectites are preferable since they affect even in the case of small addition.

The layered mineral particles can be added in a form of powder into the solution to be applied. However, in order to obtain fine dispersity even in a simple preparation method (diffusing process such as media diffusion is not required), it is preferable that the layered mineral particles are swelled by water separately to prepare gel and the gel is added to the solution to be applied.

As for the other additive materials to the hydrophilic layer, inorganic polymer or organic-inorganic hybrid polymer can be used, which are formed by so-called sol-gel method using metal alkoxide for which alkali metal silicate such as sodium silicate, potassium silicate and lithium silicate, which can be used as silicate solution, is preferable.

As for the forming of the inorganic polymer or organic-inorganic hybrid polymer, for example, a method disclosed in "Sol-gel method application" (written by Sumio Sakka, Agnesyofu-sya Co.) and methods in public art can be applied.

Water soluble resin can be contained in the present embodiment.

As for the water soluble resin, for example, resins such polysaccharide, polyethylene oxide, polypropylene oxide, polyvinyl alcohol, polyethylene glycol (PEG), polyvinyl ether, styrene-butadiene copolymer, and methyl methacrylate-butadiene copolymer, conjugated diene system polymer latex of methyl methacrylate-butadiene copolymer, acrylic system polymer latex, vinyl system polymer latex, polyacrylamide, sodium polyacrylate, and polyvinyl pyrrolidone can be given. As water soluble resin, it is preferable to use polysaccharide.

As for the polysaccharide, starches, celluloses, polyurones, pullulan and the like are available. In particular, cellulose derivatives such as methyl cellulose salt, carboxymethylcellulose salt, hydroxyethylcellulose salt are preferable. Sodium salt and ammonium salt of carboxymethylcellulose are more preferable.

That is because polysaccharide is effective in forming desirable surface profile of the hydrophilic layer when the hydrophilic layer contains polysaccharide.

The surface of the hydrophilic layer preferably comprises a concavoconvex structure of 0.1 to 20 μm pitch such like aluminum grain texture of a PS sheet.

This concavoconvex, which improves wet retentivity and holding property at an image portion, can be formed by letting the hydrophilic layer contain suitable amount of a filler having suitable particle size.

However, it is preferable that the above-described alkaline colloidal silica and the above-described water soluble polysaccharide are added to the solution to be applied, phase separation is performed in applying and drying the hydrophilic layer, and the concavoconvex structure is formed since a structure having better printing property can be obtained.

The shape of the concavoconvex structure (such as pitch and surface roughness) can be optionally controlled with additive amount and kind of alkaline colloidal silica, additive amount and kind of water soluble polysaccharide, additive amount and kind of the other additives, solids concentration of the solution to be applied, wet film thickness, drying condition and the like.

As for the inorganic particles applicable to the present embodiment, for example, metal oxide particles known in the art such as silica, alumina, titania and zirconia can be used. In order to inhibit their precipitation in the solution to be applied, porous metal oxide particles are preferable.

As for the porous metal oxide particles, the above-described porous silica particles and porous aluminosilicate particles can be preferably used.

Further, an example of the particles coated with an inorganic material can be a particle where the core thereof is an organic particle made of such as polymethylmetacrylate and polystyrene and is coated with an inorganic particle having smaller particle size than that of the core.

The particle size of the inorganic particles is preferably about 1/10 to 1/100 of the core particles.

As for the inorganic particles, metal oxide particles known in the art such as silica, alumina, titania and zirconia can be used similarly.

As for the coating method, various methods known in the art can be used. A dry type coating method such as hybridizer where coating particles are collided with core particles at high speed in air so that the coating particles are cut into the surface of the core particles and fixed, are preferably used.

Particles in which the core thereof made of an organic particle is plated with metal can be used. As for the above particles, for example, "microbal AU" produced by Sekisui Chemical Co., Ltd, which is a resin particle plated with gold, and the like can be given.

The particle size is preferably 1 to 10 μm, 1.5 to 8 μm is more preferable, and 2 to 6 μm is the most preferable.

It is preferable that the content ratio of carbon containing materials such as organic resin and carbon black is low with respect to the whole hydrophilic layer in order to improve hydrophilicity. It is preferable that the total content of these materials is less than 9 mass %, and less than 5 mass % is more preferable.

According to the present embodiment, the hydrophilic layer may comprise a plurality of layers.

For example, another hydrophilic layer (intermediate hydrophilic layer) can be provided onto one hydrophilic layer.

In the case of providing the intermediate hydrophilic layer, the material of the intermediate layer can be similar to that of the hydrophilic layer.

At least one layer of the hydrophilic layer and thermosensitive image forming layer contains light heat converting material in order to give a property to convert laser light to heat.

The layer containing the light heat converting material has a thickness of 1 to 5 μm from the viewpoint of effectiveness of light heat conversion efficiency.

In the case that both of the hydrophilic layer and thermosensitive image forming layer contain a light-heat converting material, the thickness of the layer containing the light heat converting material is the total thickness of those two.

According to the present embodiment, it is particularly preferable that the hydrophilic layer contains a light heat converting material.

The above-described transmittance can be controlled by regulating content of a light heat converting material in the hydrophilic layer and image forming layer and the thickness of the layer containing it. The content of a light heat converting material is 0.1 to 60 mass % with respect to the layer containing it, and 3 to 60 mass % is preferable and 3 to 45 mass % is more preferable.

As for the light heat converting material, infrared absorption coloring matter, organic/inorganic pigment, metal and metal oxide are preferable. Concretely, the following materials can be given.

As for the infrared absorption coloring matter, organic compounds such as cyanine system coloring matter, chroconium system coloring matter, polymethine system coloring matter, azulenium system coloring matter, squalium system coloring matter, thiopyrylium system coloring matter, naphthoquinone system coloring matter, and anthraquinone system coloring matter, organometallic complexes of such as phthalocyanine system, naphthalocyanine system, azo system, thioamide system, dithiol system, and indoaniline system can be given.

Specifically, compounds disclosed in JP Tokukaisho 63-139191 A, JP Tokukaisho 64-33547A, JP Tokukaihei 1-160683A, JP Tokukaihei 1-280750A, JP Tokukaihei 1-293342A, JP Tokukaihei 2-2074A, JP Tokukaihei 3-26593A, JP Tokukaihei 3-30991A, JP Tokukaihei 3-34891A, JP Tokukaihei 3-36093A, JP Tokukaihei 3-36094A, JP Tokukaihei 3-36095A, JP Tokukaihei 3-42281A, JP Tokukaihei 3-97589A, JP Tokukaihei 3-103476A, and the like can be given.

They can use separately or in combination of two or more kind.

As for the pigment, carbon, graphite, metal, metal oxide and the like can be given.

As for the carbon, furnace black and acetylene black are particularly preferable.

It is preferable that the grain size (d50) is less than 100 nm, and 50 nm or less is more preferable.

As for the graphite, fine particles having particle size of 0.5 μm or less, preferably 100 nm or less, more preferably 50 nm or less can be used.

As for the metal, fine particles of any metal having particle size of 0.5 μm or less, preferably 100 nm or less, more preferably 50 nm or less can be used.

As for the shape, any shapes such as globe, flake, needle and the like are possible.

In particular, colloidal metal fine particles (Ag, Au etc.) are preferable.

As for the metal oxide, materials having black color in visible range, or conductive or semiconductive materials can be used.

The content of the light heat converting material in the hydrophilic layer and image forming layer is 0.1 to 60 mass %, and 3 to 60 mass % is preferable and 3 to 45 mass % is more preferable.

In the case the hydrophilic layer and intermediate hydrophilic layer are comprised and the light heat converting material is contained in both of them, the additive amounts of the light heat converting element can be different between in the hydrophilic layer and intermediate hydrophilic layer.

<Thermosensitive Image Forming Layer>

The thermosensitive image forming layer of the present embodiment can form an image by heating, and it contains thermomelting fine particles or thermofusible fine particles.

The thermomelting fine particles are, fine particles made of a material generally classified into wax, having particularly low viscosity in melting state among thermoplastic materials.

As for the mechanical properties, it is preferable that the softening point is 40° C. or more and 120° C. or less and melting point is 60° C. or more and 100° C. or less. It is more preferable that the softening point is 40° C. or more and 100° C. or less and the melting point is 60° C. or more and 120° C. or less.

As for the available materials, for example, paraffin wax, polyolefin, polyethylene wax, microcrystalline wax, carnauba wax, candelilla wax, montan wax, fatty acid system wax, and the like can be given.

These materials have molecular weights of 800 to 10,000. In order to facilitate emulsification, these waxes can be oxidized so that a polar group such as hydroxyl, ester, carboxyl, aldehyde and peroxide is introduced.

Further, in order to lower softening point so as to improve workability, it is also possible to add stearamide, linolenamide, laurylamide, myristelamide, hardened bovine fatty amide, palmitamide, oleamide, rice sugar fatty amide, coconut fatty amide, or methylolate of these fatty amide, methylene bis stearamide, ethylene bis stearamide, etc. into these waxes.

Moreover, coumarone-indene resin, rosin modified phenolic resin, terpene modified phenol resin, xylene resin, ketone resin, acrylate resin, ionomers, and copolymers of these resin can also be used.

Among them, it is preferable to contain any one of polyethylene wax, microcrystalline wax, carnauba wax, fatty acid ester, and fatty acid.

These materials have comparatively low melting point and low melting viscosity. Thus, it is possible to perform image forming at high sensitivity.

Further, since these materials have wettability, a damage decreases in the case that a sharing force is given to the surface of the printing plate material, so that durability to printing smear caused by a scratch and the like is improved.

It is preferable that the thermofusible fine particles are dispersible to water and mean particle size thereof is 0.01 to 10 μm. More preferably it is 0.1 to 3 μm.

It is possible that the thermofusible fine particles have a structure that the composition varies continuously from the inner part to the surface, or are coated with a different material.

As for the coating method, micro capsule forming method, sol-gel method or the like known in the art can be employed.

The content of the thermofusible fine particles in constituent layers is preferably 1 to 90 mass % with respect to the whole layer, and 5 to 80 mass % is more preferable.

As for the thermofusible fine particles which can be applied to the thermosensitive image forming layer of the present embodiment, thermoplastic hydrophobic high molecular polymer fine particles can be given. The highest softening point of the thermoplastic hydrophobic high molecular polymer fine particles is not especially limited. However, it is preferably lower than decomposition temperature of the high molecular polymer fine particles. It is preferable that weight average molecular weight (Mw) of the high molecular polymer is within a range from 10,000 to 1,000,000.

As for the concrete examples of the high molecular polymer constituting the high molecular polymer fine particles, for example, diene (co)polymers such as polypropylene, polybutadiene, polyisoprene, and ethylene-butadiene copolymer, synthetic rubbers such as styrene-butadiene copolymer, methyl methacrylate-butadiene copolymer, acrylonitrile-butadiene copolymer, methacrylate ester or methacrylic ester (co)polymer such as polymethylmethacrylate, methyl methacrylate-(2-ethyl hexyl acrylate) copolymer, methyl methacrylate-methacrylic acid copolymer, methyl acrylate-(N-methylolacrylamide) copolymer and polyacrylonitrile, vinyl ester (co)polymers such as polyvinyl acetate, vinyl acetate-vinyl propionate copolymer and vinyl acetate-ethylene copolymer, vinyl acetate-(2-ethyl hexyl acrylate) copolymer, polyvinyl chloride, polyvinylidene chloride, polystyrene, and their copolymers thereof can be given.

Among them, methacrylate ester, methacrylic acid (co) polymer, vinylester (co)polymer, polystyrene, synthetic rubbers are preferably used.

The high molecular polymer fine particles can be made of high molecular polymer polymerized by any known methods such as emulsion polymerization, suspension polymerization, solution polymerization, gas phase polymerization.

As for the method to make fine particles from the high molecular polymer polymerized by solution polymerization or gas phase polymerization, a method to spray solution of the high molecular polymer with organic solvent into inert gas and to dry so as to make fine particles, a method to dissolve the high molecular polymer into organic solvent which is not soluble to water, to disperse the solution into water or aqueous medium and to exclude the organic solvent to make fine particles, can be given.

In the polymerizing or making fine particles of the thermofusible or thermomelting fine particles, surfactant such as sodium lauryl sulfate, sodium dodecylbenzene sulfonate and polyethylene glycol, and water soluble resin such as polyvinyl alcohol can be used as a dispersant or stabilizer according to need.

Further, triethylamine, triethanolamine and the like can be contained.

It is preferable that the thermoplastic fine particles can be dispersed into water. The mean particle size thereof is preferably 0.01 to 10 μm, and 0.1 to 3 μm is more preferable.

It is possible that the thermoplastic fine particles have a structure that the composition varies continuously from the inner part to the surface, or are coated with a different material.

As for the coating method, micro capsule forming method, sol-gel method or the like known in the art can be employed.

The content of the thermofusible fine particles in constituent layers are preferably 1 to 90 mass % with respect to the whole layer, and 5 to 80 mass % is more preferable.

The thermosensitive image forming layer of the present embodiment can further contain water soluble material.

When water soluble material is contained, a property to eliminate unexposed portion of the thermosensitive image forming layer is improved, in which the unexposed portion is eliminated with dampening water or ink.

As for the water soluble material, the water soluble resin given as a material which can be contained in the hydrophilic layer can be used. Saccharides, especially oligo saccharides, are preferable for image forming of the present embodiment.

Among the oligo saccharides, trehalose has extremely fine developing property and preservability, since it has high solubility to water despite its extremely low hygroscopicity. Further, one having comparatively high purity is industrially available at low cost.

Hydrated oligo saccharide is melted with heat to eliminate hydrated water, and subsequently is solidified to be an anhydrated crystal (for a short period after the solidification). Trehalose is characterized in that melting point of the anhydrate thereof is 100° C. or more higher than that of the hydrate thereof.

This means that the exposed portion where the portion is melted with heat by infrared light exposure and is re-solidificated has high melting point just after the re-solidification. Thus, it is effective in reducing image defect in exposure such as banding.

Among the oligo saccharides, trehalose is preferable.

The content of the oligo saccharide in the thermosensitive image forming layer is preferably 1 to 90 mass % with respect to the whole layer, and 10 to 80 mass % is more preferable.

(Back Coating Layer)

A back coating layer can be formed on backside of the sheet printing plate material of the present embodiment. It is preferable that compounds providing surface smoothness or conductivity are added to the back coating layer as well as a binder component and matting agent.

As for the binder, gelatin, polyvinyl alcohol, polymethyl cellulose, cellulose nitrate, acetyl cellulose, aromatic polyamide resin, silicone resin, epoxy resin, alkyd resin, phenol resin, melamine resin, fluororesin, polyimide resin, urethane resin, acrylate resin, urethane denaturation silicone resin, polyethylene resin, polypropylene resin, Teflon (R) resin, polyvinyl butyral resin, vinyl chloride system resin, polyvinyl acetate, polycarbonate, organic boron compound, aromatic esters, fluoropolyurethane, polyethersulfone, polyester resin, polyamide resin, polystyrene resin, or general polymer such as copolymers whose main ingredients are the monomers of the above polymers, can be used.

The usage of cross linkable binder as the binder is effective in preventing matting agent powder from falling off and in improving scratch resistance.

It is also effective in blocking at preservation.

As for the means to crosslink, it is not especially limited and any one of heat, active ray and pressure or the combination thereof can be employed depending on property of the crosslinking agent to be used.

In some case, an optional adhesible layer can be provided to the base material on the side where the back coating layer is provided in order to give adhesive properties to the base material.

Organic or inorganic fine particles are preferably added to the back coating layer as matting agent.

As for the organic fine particles, organic fine particles made of silicone resin, fluorine resin, acrylic resin, methacrylic resin or melamine resin can be given. Among them, silicone resin, acrylic resin and methacrylic resin are preferable.

Further, fine particles of radical polymerization system polymer such as polymethylmethacrylate (PMMA), polystyrene resin, polyethylene resin, polypropylene resin, and fine particles of polycondensation polymer such as polyester, and polycarbonate, and the like can be given.

As for the inorganic particles, silicon oxide, calcium carbonate, titanium dioxide, aluminum oxide, zinc oxide, barium sulfate, and zinc sulfate and the like can be given as inorganic particles. Among them, titanium dioxide, calcium carbonate, and silicon oxide are preferable.

Mean particle size of the inorganic fine particles are preferably 0.5 to 20 μm, and 1 to 10 μm is more preferable.

When the mean particle size is less than 0.5 μm, decompression for long time period is required in order to obtain uniform contact since the back coating layer cannot be roughened sufficiently.

When the mean particle size is over 20 μm, it is impossible to obtain stable adherence with fixing member since the back coating layer is too rough and the Smoostar value is large. Here, Smoostar value represents surface smoothness and gas transparency of the sample, which is measured according to a measuring standard described in "JAPAN TAPPI Paper and pulp test method", JAPAN TAPPI.

It is preferable that coating mass of the back coating layer is about 0.5 to 3 $g/m^2$.

In case that matting agent is not added, it is preferable that the coating mass of the back coating layer is 0.01 to 1.0 $g/m^2$.

The content of the above fine particles is preferably 0.5 to 80 mass % with respect to the whole solid mass of the back coating layer, and 1 to 20 mass % is more preferable.

In order to regulate surface smoothness, various surfactant, silicone oil, fluorine system resin, waxes and the like are preferably added to the backcoat layer.

Antistatic agent can be added in order to prevent that the printing plate material is fed anomaly caused by triboelectric charging and an inclusion is adhered to the printing plate material caused by charging, As for the antistatic agent, cationic surfactant, anionic surfactant, nonionic surfactant, polymer antistatic agent, conductive fine particles can be used.

Among them, fine particles of metal oxide such as carbon black, graphite, tin oxide, zinc oxide and titanium oxide, and conductive fine particles such as organic semiconductor are preferably used.

In particular, carbon black, graphite and fine particles of metal oxide are preferable since they provide stable anti-charging property regardless of an environment such as temperature.

The metal oxide fine particles are preferably contained in the back coating layer within the range from 10 to 90 mass %.

The mean particle size of the metal oxide fine particles is preferably within the range from 0.001 to 0.5 μm.

The mean particle size referred to in the invention is a value including not only primary particle size of metal oxide fine particles but also those of higher order structure.

The printing plate material of the invention may comprise the above-described antistatic layer on the support at the image forming layer side.

It is also preferable that the above-described transmittance of the back coating layer is 1% to 40%.

As for the semiconductor laser used in the present embodiment, a semiconductor laser having comparatively long wavelength in infrared range is preferably used. In order to attain the above transmittance, compounds which absorb, diffuse and reflect light of this wavelength can be contained.

As for the compounds to reflect and diffuse light at exposing wavelength, titanium oxide, barium sulfate, zinc oxide, calcium carbonate, polyethylene and the like can be given. It is preferable that they are diffused and mixed into the solution to be applied in applying the back coating layer.

As for the compound to absorb light at exposing wavelength, it can be selected from carbon black, metal salt of phthalocyanine such as copper, aluminum and titanium, cyanine system coloring matter, polymethine system coloring matter, squalium system coloring matter and the like. It is preferable that they are diffused and mixed into the solution to be applied in applying the back coating layer.

<Laser Exposure>

As for the laser exposure to the sheet printing plate material, scanning exposure using laser at the wavelength from 700 to 1000 nm is preferably performed.

The laser can be a gas laser. A semiconductor laser emitting at near infrared range is particularly preferable.

An image is exposed to the sheet printing plate material with laser light in a state where it is fixed onto the fixing member with closely contacted.

As for the apparatus suitable for the exposure, any apparatus which can form an image onto a surface of the printing plate material with a semiconductor laser according to an image signal from a computer can be given. Hereinafter, the exposure methods used in the embodiment are given.

(1) A method to perform a two dimensional scanning to the sheet printing plate material fixed onto the tabular fixing member with closely contacted therewith by using one or a plurality of laser beams, so as to expose an entire area of the printing plate material.

(2) A method to perform scanning to the sheet printing plate material fixed onto inner side of the fixed cylindrical fixing member where the sheet is fixed along with the cylinder surface with closely contacted therewith, by scanning one or a plurality of laser beam irradiated from inside of the drum in a circumferential direction of the cylinder (main scanning direction), while moving it in a direction perpendicular to the circumferential direction (sub scanning direction), so as to expose an entire area of the printing plate material.

(3) A method to perform scanning to the sheet printing plate material fixed with closely contacted, by scanning one or plurality of laser beam irradiated from outside of the drum in a circumferential direction (main scanning direction) by a rotation of the drum, while moving it in a direction perpendicular to the circumferential direction (sub scanning direction), so as to expose an entire area of the printing plate material.

Embodiment

Hereinafter, the invention is specifically explained with the embodiment.

Reflectances (%) of drums a, b, c and d where surface treatments were different from one another were measured at various wavelength of the light source.

The reflectance (%) on the surfaces of each drum was merely changed at wavelength of the light source of approximately 660 nm or less. However it increased from approximately 660 nm to 700 nm or more.

Figure 8A:
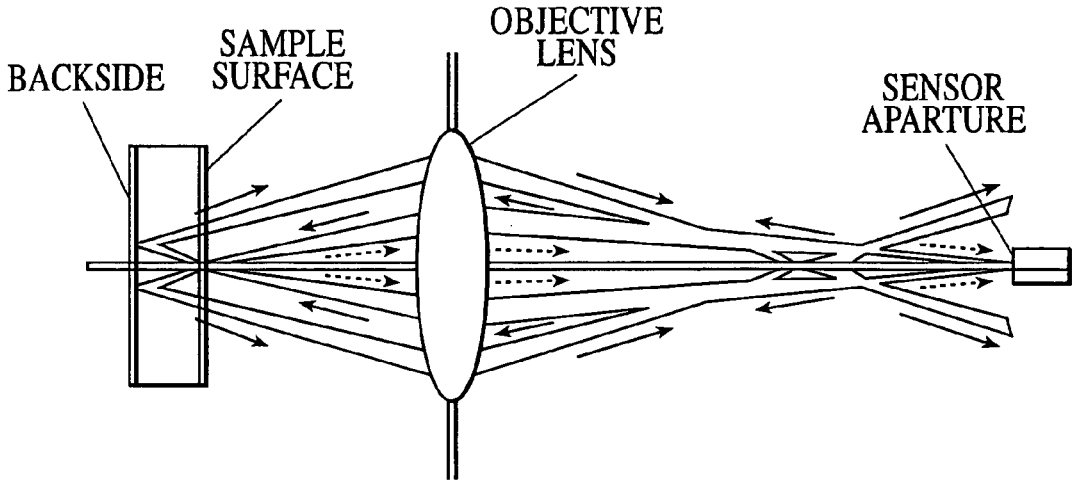
FIG. 8 is a view showing a principle of the measuring apparatus used in the embodiment.
Figure 8B:
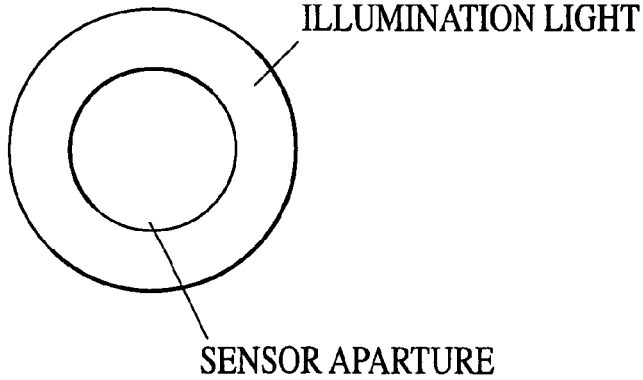

"OLYMPUS USPM" was used as a measuring apparatus. As shown in FIG. 8, "OLYMPUS USPM" irradiates irradiating light to a sample through an objective lens, excludes the reflected light at backside of the sample, leads the reflected light at the sample surface to an aperture of a sensor so as to perform measurement.

In order to exclude the reflection light from the backside of the sample, the illumination is torus (doughnut shape).

In the present embodiment, sheet printing plate materials A and B and drums a, b, c and d shown in FIG. 9 were used, in which their reflectance (%) were measured with the measuring apparatus "OLYMPUS USPM". The sheet printing plate material was wound on the circumference of the drum, and scanning exposure of an image is performed to it with the light source by rotating the drum, so that the image were recorded.

When the wavelength (nm) of the light source was 808 nm, the transmittance of the sheet printing plate material A was 5%, and that of the sheet printing plate material B was 25%. When the wavelength (nm) of the light source was 808 (nm), the reflectance of the drum a was 2%, that of the drum b was 7%, that of drum c was 15%, and that of drum d was 28%.

Scanning exposure of an image was performed with the light source by rotating the drum, so that the image was recorded. Density nonuniformity of the image was observed visually.

These results are shown in FIG. 10.

In FIG. 10, "A" designates no density nonuniformity, "B" designates density nonuniformity is slightly observed, and "C" designates clear density nonuniformity is observed remarkably.

When the sheet printing plate material A was used, preferable results were obtained in the case of using the drums a, b and c. However, in the case of using the drum d, clear density nonuniformity was observed remarkably.

When the sheet printing plate material B was used, preferable results were obtained in the case of using the drums a and b. However, in the case of using the drums c and d, clear density nonuniformity was observed remarkably, and it was impossible to obtain preferable result.

The reflectance on the drum surface at the light source wavelength to be used was 0.1 to 10%. By lowering the reflectance on the surface of the drum, the difference of infrared return light between surface of the drum and the bottom surface of the groove is reduced, so that density nonuniformity is reduced.

The entire disclosure of Japanese Patent Application No. 2003-428591 filed on Dec. 25, 2003, including specification, claims, drawings and summary are incorporated herein by reference.

What is claimed is:

1. A sheet printing plate material comprising:

a plastic support having optical transparency for light having a wavelength of 750 to 1000 nm, and at least a hydrophilic layer and a thermosensitive image formed layer forming on the plastic support, wherein the sheet printing plate material has a transmittance of 1 to 5% at the wavelength to be used and is wound on a drum having surface reflectance of 0.1 to 10% at the wavelength to be used, and the sheet printing plate material is used for an image recording apparatus where the drum is rotated to expose image data with a light source where the light has a wavelength of 750 to 1000 nm so that an image is recorded.

2. The sheet printing plate material of claim 1, wherein the plastic support is made of polyethylene terephthalate.

3. The sheet printing plate material of claim 1, wherein the plastic support has 100 to 250 μm thickness.

4. An image recording apparatus comprising a drum and a printing plate material or a sheet printing plate wound around a surface of the drum, wherein the sheet printing plate material or the sheet printing plate have a transmittance of 1 to 5% at the wavelength to be used and comprise a plastic support having optical transparency for light having a wavelength of 750 to 1000 nm and a hydrophilic layer and a thermosensitive layer provided on the plastic support, the drum is rotated to perform a scanning exposure of an image with a light source where the light has a wavelength of 750 to 1000 nm so that an image is recorded, and the drum has surface reflectance of 0.1 to 10% at the wavelength to be used.

5. The image forming apparatus of claim 4, wherein the light source is a semiconductor laser.

6. The image forming apparatus of claim 4, wherein the surface of the drum is formed by a surface treatment containing a carbon black pigment.

7. The image forming apparatus of claim 4, further comprising an exposing unit, wherein the exposing unit has image intensity of 100 to 400 $mJ/cm^2$ in image recording.

* * * * *